US011271289B2

(12) United States Patent
Su et al.

(10) Patent No.: US 11,271,289 B2
(45) Date of Patent: Mar. 8, 2022

(54) BASE STATION ANTENNA

(71) Applicant: CommScope Technologies LLC, Hickory, NC (US)

(72) Inventors: Ruixin Su, Jiangsu (CN); PuLiang Tang, Jiangsu (CN); Keyun Di, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/995,019

(22) Filed: Aug. 17, 2020

(65) Prior Publication Data

US 2021/0075092 A1 Mar. 11, 2021

(30) Foreign Application Priority Data

Sep. 11, 2019 (CN) ..... 201910855322.7

(51) Int. Cl.
*H01Q 1/42* (2006.01)
*H01Q 1/24* (2006.01)
*H01Q 1/40* (2006.01)

(52) U.S. Cl.
CPC ..... *H01Q 1/246* (2013.01); *H01Q 1/405* (2013.01); *H01Q 1/427* (2013.01)

(58) Field of Classification Search
CPC ..... H01Q 1/246; H01Q 1/42; H01Q 1/427; H01Q 1/405; H01Q 15/14
See application file for complete search history.

(56) References Cited

U.S. PATENT DOCUMENTS 8,199,063 B2 * 6/2012 Moon ..... H01Q 21/08 343/810
2004/0201543 A1 * 10/2004 Gottl ..... H01Q 21/0087 343/912
2018/0337443 A1 11/2018 Bisiules et al.

FOREIGN PATENT DOCUMENTS

WO 2017165512 A1 9/2017
WO 2019127011 A1 7/2019

OTHER PUBLICATIONS

"Extended European Search Report corresponding to European Application No. 20195815.4 dated Feb. 9, 2021".

* cited by examiner

*Primary Examiner* — Hoang V Nguyen
(74) *Attorney, Agent, or Firm* — Myers Bigel, P.A.

(57) ABSTRACT

The present disclosure relates to a base station antenna. The base station antenna comprises: a reflector and radome supports mounted on the reflector, wherein the reflector comprises a body portion and a bent portion, the bent portion including at least a first section that is connected to and bent relative to the body portion of the reflector, wherein one or more arrays of radiating elements are mounted on or above the body portion of the reflector, wherein the radome support includes a support portion for supporting the radome and a mating portion for mating with the reflector, wherein a first support limiting portion is provided on the mating portion of the radome support, a first reflector limiting portion mating with the first support limiting portion is provided on the body portion of the reflector, and the first support limiting portion mates with the first reflector limiting portion to limit at least the position of the radome support in a width direction H. This enables the radome supports to be mounted on the reflector at an efficient and reliable manner.

25 Claims, 10 Drawing Sheets

BASE STATION ANTENNA

RELATED APPLICATION

The present application claims priority to and the benefit of Chinese Patent Application No. 201910855322.7, filed Sep. 11, 2019, the disclosure of which is hereby incorporated herein in its entirety.

FIELD OF THE INVENTION

The present disclosure relates generally to the field of radio antennas. More specifically, the present disclosure relates to base station antennas.

BACKGROUND OF THE INVENTION

Base station antennas, usually placed in the open air, may be directly affected by storms, ice, snow, dust and solar radiation in the natural environment, resulting in reduced accuracy, shortened service life and poor reliability of the antenna system. Thus, it is necessary to provide a radome in the base station antenna to protect the antenna system from the external environment.

In order to secure the radome and prevent it from toppling to damage the antenna system, there is usually a further demand to additionally provide radome supports to support the radome. Due to the presence of design errors and manufacturing tolerances, how to mount the radome supports at high efficiency and reliability has become a problem urgently to be solved.

SUMMARY

Thus, an object of the present disclosure is to provide a base station antenna capable of overcoming at least one drawback in the prior art.

According to a first aspect of the present disclosure, there is provided a base station antenna, characterized in that the base station antenna comprises: a reflector and a radome support mounted on the reflector, wherein the reflector comprises a body portion and a bent portion, the bent portion including at least a first section that is connected to and bent relative to the body portion of the reflector, wherein one or more arrays of radiating elements are mounted on or above the body portion of the reflector, wherein the radome support includes a support portion for supporting the radome and a mating portion for mating with the reflector, wherein a first support limiting portion is provided on the mating portion of the radome support, a first reflector limiting portion is provided on the body portion of the reflector, and the first support limiting portion mates with the first reflector limiting portion to limit at least a position of the radome support in a width direction H.

According to the present disclosure, the first reflector limiting portion is capable of being constructed on the body portion of the reflector at a high precision, thereby preventing mounting of the radome support from being difficult or the mounting stability from deteriorating due to the manufacturing errors. Further, the first reflector limiting portion and the first support limiting portion are allowed to be tightly fitted together, thereby improving at least the stability of the radome support in the width direction H.

In some embodiments, the first support limiting portion is configured as a first protrusion on the mating portion, the first reflector limiting portion is configured as a first groove in the body portion of the reflector, and the first protrusion is configured to be snapped into the first groove, the first groove limiting at least the position of the radome support in the width direction H.

In some embodiments, the first reflector limiting portion and the first support limiting portion mate with each other to limit at least the position of the radome support in the width direction H and a length direction V.

In some embodiments, the first protrusion is configured as an extension bar extending in a length direction V on the mating portion.

In some embodiments, a second support limiting portion is provided on the mating portion of the radome support, and correspondingly a second reflector limiting portion is provided on the bent portion of the reflector.

In some embodiments, the second reflector limiting portion mating with the second support limiting portion limits at least the position of the radome support in a forward-backward direction F.

In some embodiments, the second reflector limiting portion is provided on the first section of the bent portion.

In some embodiments, the second support limiting portion is configured as a second protrusion on the mating portion, the second reflector limiting portion is configured as a second groove in the bent portion, and the second protrusion is configured to be snapped into the second groove, the second groove capable of limiting at least the position of the radome support in the forward-backward direction F.

In some embodiments, an interference elastic portion is further provided on the mating portion of the radome support.

In some embodiments, the interference elastic portion abuts against the bent portion of the reflector.

In some embodiments, the interference elastic portion abuts against an inner surface of the first section of the bent portion of the reflector.

In some embodiments, the interference elastic portion is integrally formed on the mating portion of the radome support.

In some embodiments, the interference elastic portion is configured as a hollow portion on the mating portion of the radome support.

In some embodiments, the radome support is constructed as an injection-molded part.

In some embodiments, the interference elastic portion is provided with a friction reinforcing structure on a surface thereof.

In some embodiments, the base station antenna includes a plurality of radome supports, which are spaced apart from one another in a length direction V.

In some embodiments, the radome support spans from a first side to an opposite second side of the reflector in the width direction H.

In some embodiments, the bent portion further includes a second section connected to the first section and a third section connected to the second section, the second section being bent relative to the first section, and the third section being bent relative to the second section.

In some embodiments, the first section is bent relative to the body portion of the reflector at an angle ranging from 85 to 95 degrees.

In some embodiments, the second section is bent relative to the first section at an angle ranging from 85 to 95 degrees, and the third section is bent relative to the second section at an angle ranging from 85 to 95 degrees.

In some embodiments, the first section is bent downward or upward relative to the body portion of the reflector.

In some embodiments, the second section is bent leftward or rightward with respect to the first section, and the third section is bent upward or downward with respect to the second section.

In some embodiments, a phase shifting network and/or a feed network is mounted on the bent portion.

In some embodiments, a phase shifting network and/or a feed network is mounted on the third section of the bent portion.

In some embodiments, the radome support is configured as an arc-shaped support.

In some embodiments, the support portion of the radome support is provided therein with an opening, by means of which a parasitic element for the radiating element is mounted.

DETAILED DESCRIPTION

Figure 1:
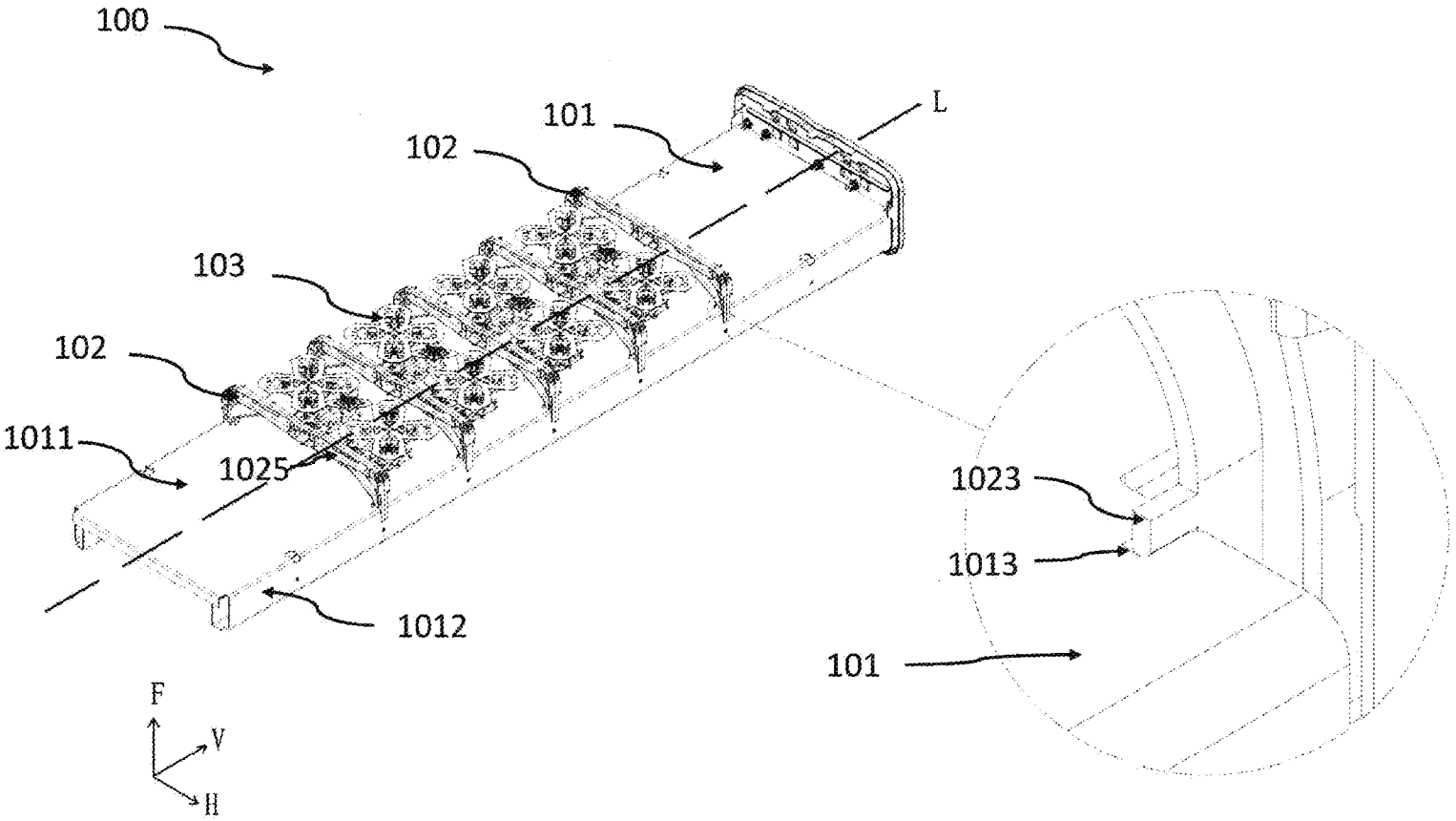
FIG. 1 is a schematic perspective view of a base station antenna according to an embodiment of the present disclosure.

The present disclosure will be described below with reference to the drawings, in which several embodiments of the present disclosure are shown. It should be understood, however, that the present disclosure may be implemented in many different ways, and is not limited to the example embodiments described below. In fact, the embodiments described hereinafter are intended to make a more complete disclosure of the present disclosure and to adequately explain the scope of the present disclosure to a person skilled in the art. It should also be understood that, the embodiments disclosed herein can be combined in various ways to provide many additional embodiments.

It is to be understood that like numbers refer to like elements throughout. In the drawings, for the sake of clarity, the sizes of certain features may be modified.

It should be understood that, the wording in the specification is only used for describing particular embodiments and is not intended to define the present disclosure. All the terms used in the specification (including technical and scientific terms) have the meanings as normally understood by a person skilled in the art, unless otherwise defined. For the sake of conciseness and/or clarity, well-known functions or constructions may not be described in detail.

The singular forms "a/an" and "the" as used in the specification, unless clearly indicated, all contain the plural forms. The words "comprising", "containing" and "including" used in the specification indicate the presence of the claimed features, but do not preclude the presence of one or more additional features. The wording "and/or" as used in the specification includes any and all combinations of one or more of the relevant items listed. The phases "between X and Y" and "between about X and Y" as used in the specification should be construed as including X and Y. As used herein, phrases such as "between about X and Y" mean "between about X and about Y". As used herein, phrases such as "from about X to Y" mean "from about X to about Y."

In the specification, when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being "directly on", "directly attached" to, "directly connected" to, "directly coupled" with or "directly contacting" another element, there are no intervening elements present. In the specification, references to a feature that is disposed "adjacent" another feature may have portions that overlap, overlie or underlie the adjacent feature.

In the specification, words describing spatial relationships such as "up", "down", "left", "right", "forth", "back", "high", "low" and the like may describe a relation of one feature to another feature in the drawings. It should be understood that these terms also encompass different orientations of the apparatus in use or operation, in addition to encompassing the orientations shown in the drawings. For example, when the apparatus shown in the drawings is turned over, the features previously described as being "below" other features may be described to be "above" other features at this time. The apparatus may also be otherwise oriented (rotated 90 degrees or at other orientations) and the relative spatial relationships will be correspondingly altered.

In a base station antenna, a radome is a structure that protects an antenna system from external environments. The radome has good electromagnetic wave penetration properties in electrical performance, and has high mechanical performance in resisting against harsh external environments such as storms, ice, snow, solar radiation, or the like. Typically, radome supports may be additionally mounted within the base station antenna to support the radome such that the radome can be further secured to be prevented from toppling to damage the antenna system.

Referring to FIG. 1, a schematic perspective view of a base station antenna in accordance with an embodiment of the present disclosure is shown. The base station antenna is generally indicated by reference numeral 100. As shown in FIG. 1, the base station antenna 100 includes a reflector 101, radome supports 102 mounted on the reflector 101, a feed board (not shown), and arrays of radiating elements 103 mounted on the feed board. The radome supports 102 are capable of supporting the radome (not shown) to maintain the stability of the radome and protect functional devices such as the arrays of radiating elements 103 that are mounted inside the radome on the reflector 101.

Figure 2A:
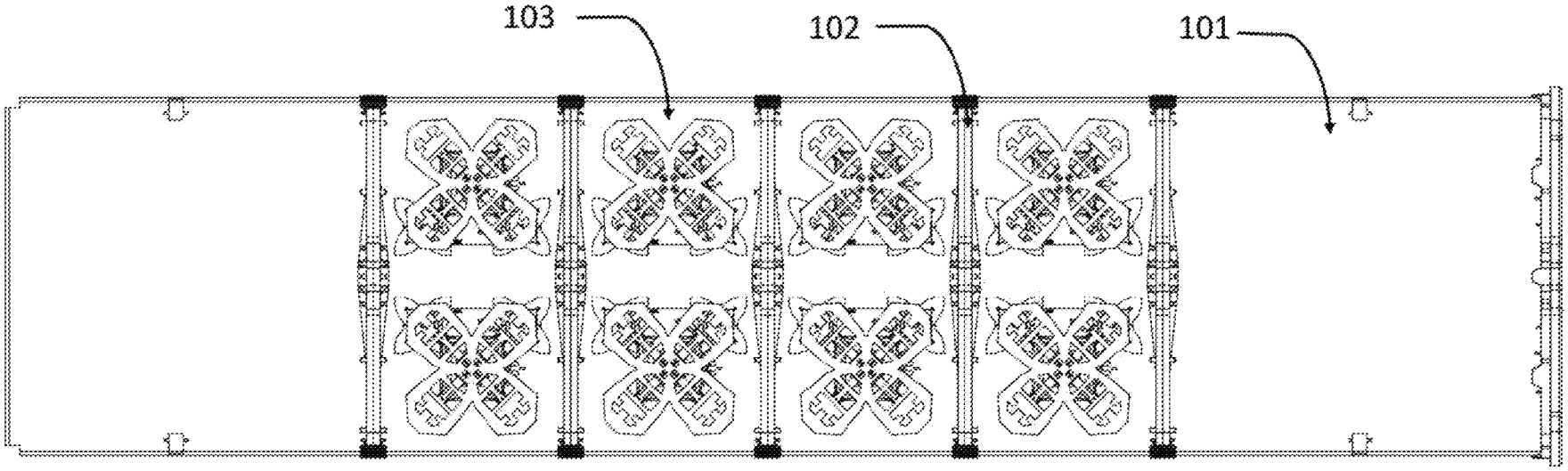
FIG. 2*a* is a schematic top view of the base station antenna of FIG. 1.
Figure 2B:
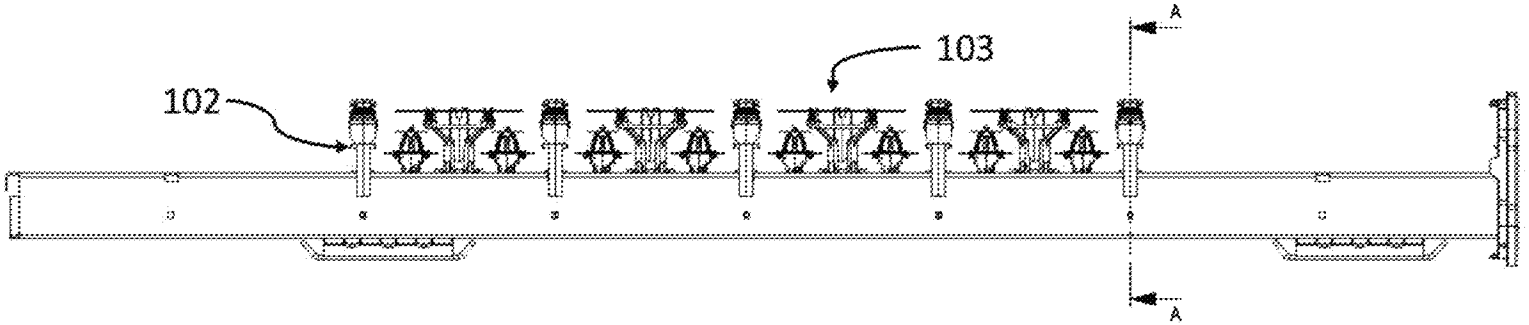
FIG. 2*b* is a schematic side view of the base station antenna of FIG. 1.
Figure 2C:
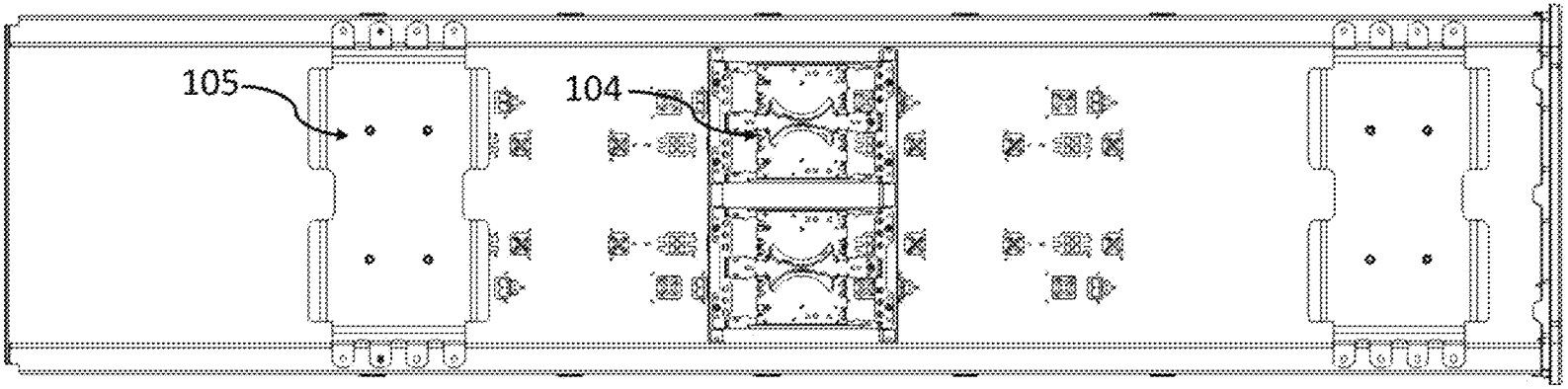
FIG. 2*c* is a schematic bottom view of the base station antenna of FIG. 1.
Figure 2D:
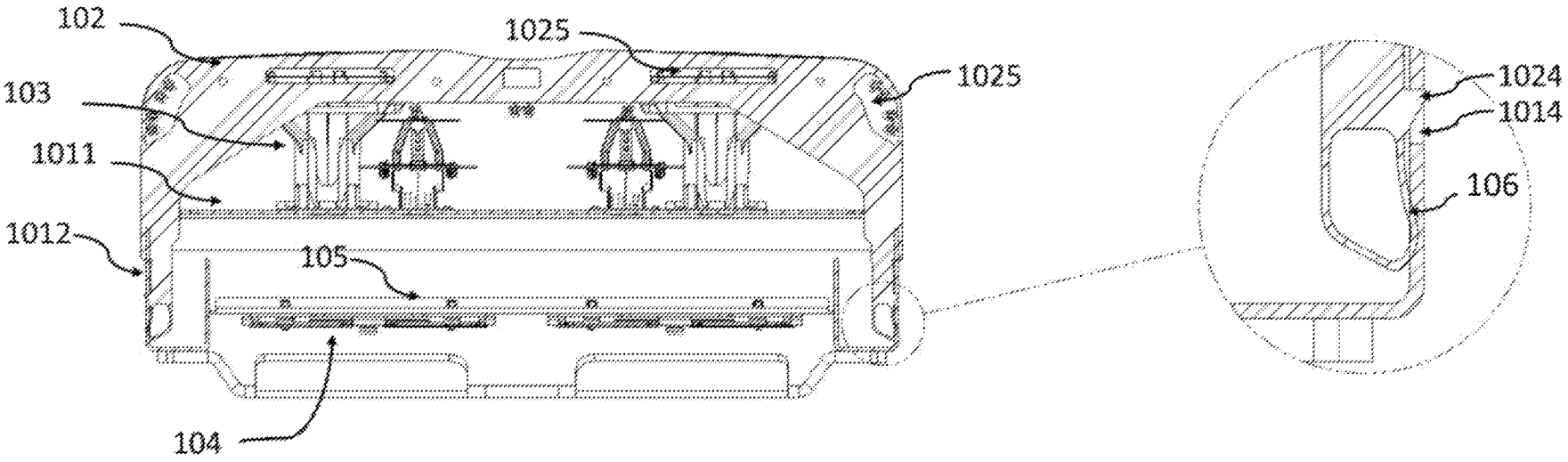
FIG. 2*d* is a schematic cross-sectional view taken along line A-A in FIG. 2*b;*

With reference to FIG. 2*a*, a schematic top view of the base station antenna of FIG. 1 is shown; with reference to FIG. 2*b*, a schematic side view of the base station antenna of FIG. 1 is shown; with reference to FIG. 2*c*, a schematic bottom view of the base station antenna of FIG. 1 is shown;

with reference to FIG. 2*d*, a schematic cross-sectional view taken along line A-A in FIG. 2*b* is shown.

In the present disclosure, the arrays of radiating elements 103 may be mounted in rows on or above the reflector 101 of the base station antenna 100. The arrays of radiating elements 103 may extend from a lower end portion to an upper end portion of the base station antenna 100 in a length direction V, which may be the direction of a longitudinal axis L of the base station antenna 100 or may be parallel to the longitudinal axis L. The length direction V is perpendicular to a width direction H and a forward-backward direction F. The arrays of radiating elements may extend forward from the feed board in the forward-backward direction F. The arrays may be, for example, linear arrays of radiating elements or two-dimensional arrays of radiating elements. In the current embodiment, only two arrays of radiating elements, namely, a 4×2 array of low band radiating elements and an 8×2 array of high band radiating elements, are exemplarily shown. In other embodiments, a plurality of arrays of radiating elements (e. g., a plurality of arrays of high band radiating elements andior a plurality of arrays of low band radiating elements) may be mounted on the reflector 101.

In the present disclosure, the reflector 101 may include a body portion 1011 and a bent portion 1012. The body portion 1011 may be configured as a substantially flat plane, on or above which a series of functional components, such as the feed boards and the arrays of radiating elements 103, may be mounted. The bent portion 1012 may be configured as a bent structure that is disposed laterally, for example, on both sides, of the body portion 1011.

Figure 3A:
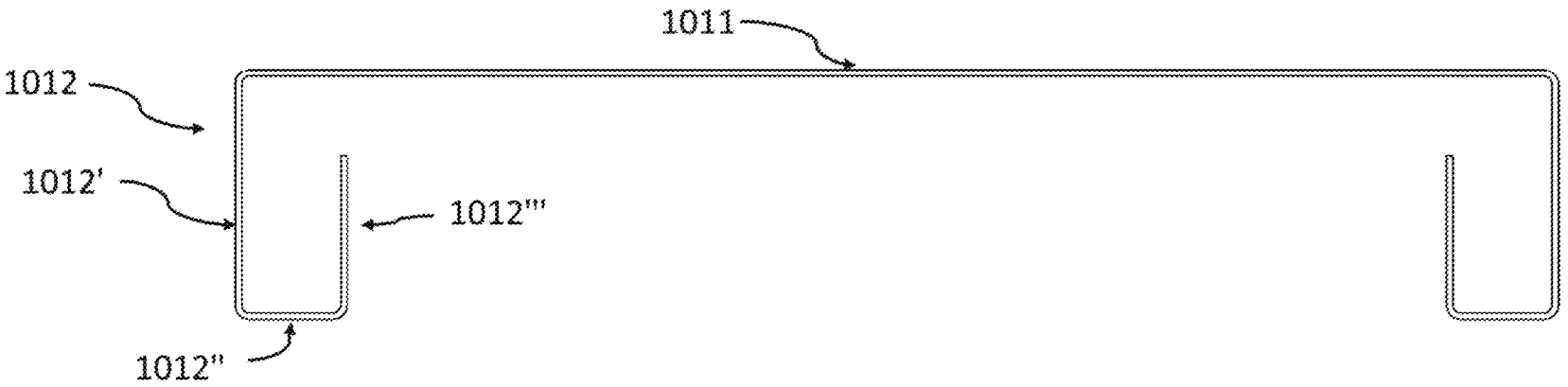
FIG. 3*a* is a schematic cross-sectional view of a reflector according to a first embodiment of the present disclosure.

Referring to FIG. 3*a*, a schematic cross-sectional view of the reflector 101 according to a first embodiment of the present disclosure is shown. The embodiment shown in FIG. 1 corresponds to the first embodiment of the reflector 101. As shown in FIG. 3*a*, the reflector 101 may include a body portion 1011 in the middle and bent portions 1012 on both sides. That is, there may be one bent portion 1012 on each side of the body portion 1011. The body portion 1011 may be constructed as a main section with a substantially flat surface, on or above which the arrays of radiating elements 103 may be mounted for receiving and/or transmitting RF signals. The bent portion 1012 may be configured as a multi-section structure, such as a multi-section hook-type structure, which may include a first section 1012' that is connected to and bent relative to the body portion 1011, a second section 1012" that is connected to and bent relative to the first section 1012', and a third section 1012'" that is connected to and bent relative to the second section 1012". In the first embodiment, the bent portions 1012 on both sides are bent toward each other, in other words, the third sections 1012' on both sides are spaced apart from each other at a distance shorter than the distance between the first sections 1012' on both sides. The first section 1012' is bent substantially 90° with respect to the body portion 1011, and extends substantially vertically downward from the body portion 1011. The second section 1012" is bent substantially 90° relative to the first section 1012', and extends inward (i.e., the second section on the left side extends rightward, and the second section on the right side extends leftward). The third section 1012' is bent substantially 90° relative to the second section 1012", and extends substantially vertically upward from the second section 1012".

Figure 3B:
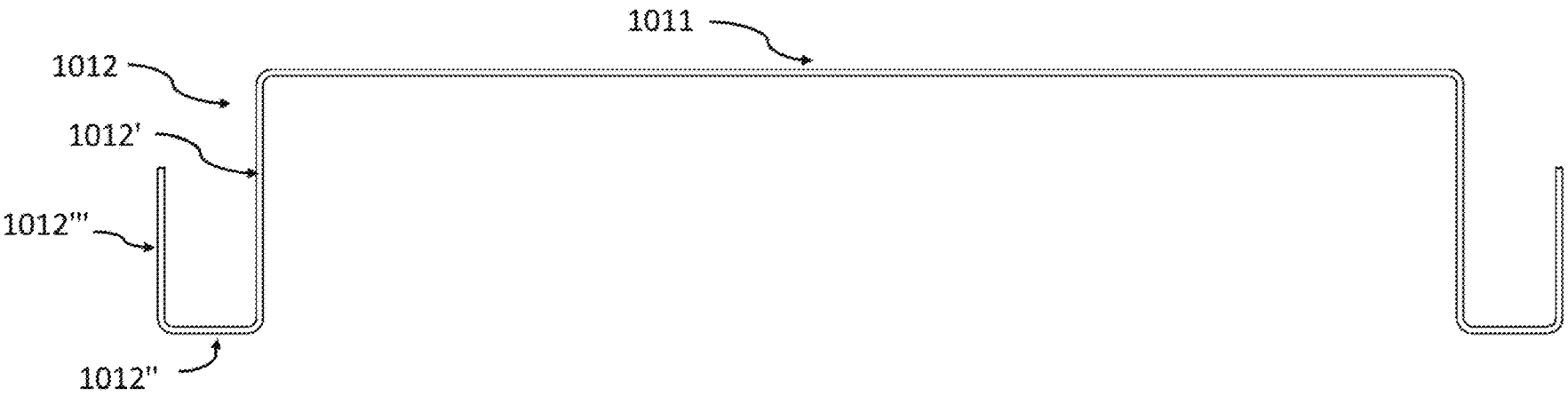
FIG. 3*b* is a schematic cross-sectional view of the reflector according to a second embodiment of the present disclosure.

Referring to FIG. 3*b*, a schematic cross-sectional view of the reflector 101 according to a second embodiment of the present disclosure is shown. As shown in FIG. 3*b*, the reflector 101 may include a body portion 1011 in the middle and bent portions 1012 on both sides. The body portion 1011 may be constructed as a main section with a substantially flat surface. The bent portion 1012 may be configured as a multi-section structure, such as a multi-section hook-type structure, which may include a first section 1012' that is connected to and bent relative to the body portion 1011, a second section 1012" that is connected to and bent relative to the first section 1012', and a third section 1012'" that is connected to and bent relative to the second section 1012". In the second embodiment, the bent portions 1012 on both sides are bent away from each other, in other words, the third sections 1012'" on both sides are spaced apart from each other at a distance longer than the distance between the first sections 1012' on both sides. The first section 1012' is bent substantially 90° with respect to the body portion 1011, and extends substantially vertically downward from the body portion 1011. The second section 1012" is bent substantially 90° relative to the first section 1012', and extends outward (i.e., the second section on the left side extends leftward, and the second section on the right side extends rightward). The third section 1012'" is bent substantially 90° relative to the second section 1012", and extends substantially vertically upward from the second section 1012".

Figure 3C:
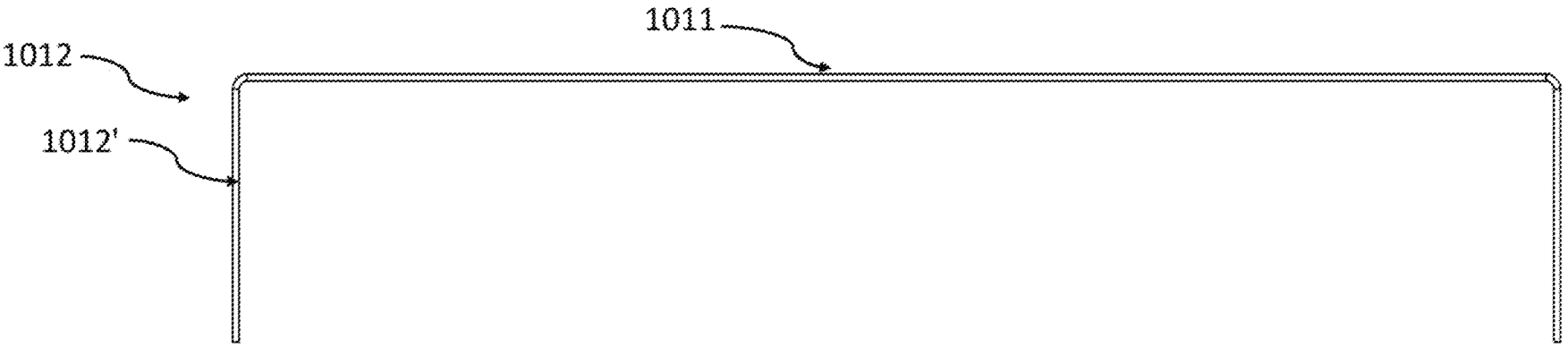
FIG. 3*c* is a schematic cross-sectional view of the reflector according to a third embodiment of the present disclosure.

Referring to FIG. 3*c*, a schematic cross-sectional view of the reflector 101 according to a third embodiment of the present disclosure is shown. As shown in FIG. 3*c*, the reflector 101 may include a body portion 1011 in the middle and bent portions 1012 on both sides. The body portion 1011 may be integrally formed with the bent portion 1012, or may be joined by an additional connecting device. The body portion 1011 may be constructed as a main section with a substantially flat surface. The bent portion 1012 may include a first section 1012' that is connected to and bent relative to the body portion 1011. In the third embodiment, the first section 1012' is bent substantially 90° with respect to the body portion 1011, and extends substantially vertically downward from the body portion 1011.

It should be understood that the various embodiments of the bent portion 1012 as mentioned above in the present disclosure are merely exemplary, and the bent portion 1012 may also have other suitable variations.

In the present disclosure, the structural design of the bent portion 1012 may be advantageous: firstly, the bent portion 102 of the present disclosure may have choking effect, which advantageously improves the RF performance such as a radiation pattern of the antenna; secondly, the bent portion 102 of the present disclosure may also play a supporting role (for example, a phase shifting network and/or a feed network 104 may be mounted on the bent portion 102). Referring to FIGS. 2*c* and 2*d*, a mounting bracket 105 may be secured to the bent portion 1012, for example, to the third section 1012'" of the bent portion 1012, and the mounting bracket 105 may be equipped with a phase shifting network and/or a feed network 104 for the arrays of the radiating elements 103. This results in a compact structure in a limited space. Advantageously, there may be no electrical connection between the bent portion 1012 and the phase shifting network and/or the feed network 104, which can contribute to an improvement in the PIM performance of the base station antenna 100.

In the present disclosure, the radome supports 102 may also be mounted in rows on the reflector 101 of the antenna to provide adequate support for the radome. As can be seen from FIGS. 1, 2*a* and 2*c*, the radome support 102 may span from a first side to an opposite second side of the reflector 101 (body portion 1011) in the width direction H. The radome supports 102 may be disposed at a distance from each other along the length direction V, and a plurality of radiating elements 103 may be disposed between adjacent radome supports 102. The radome support 102 may extend forward from the reflector 101 in the forward-backward direction F, and may have a height larger than that of the radiating element 102 so as to effectively protect the radiating element 103 and prevent the radome from toppling to damage the radiating element 103.

Figure 4A:
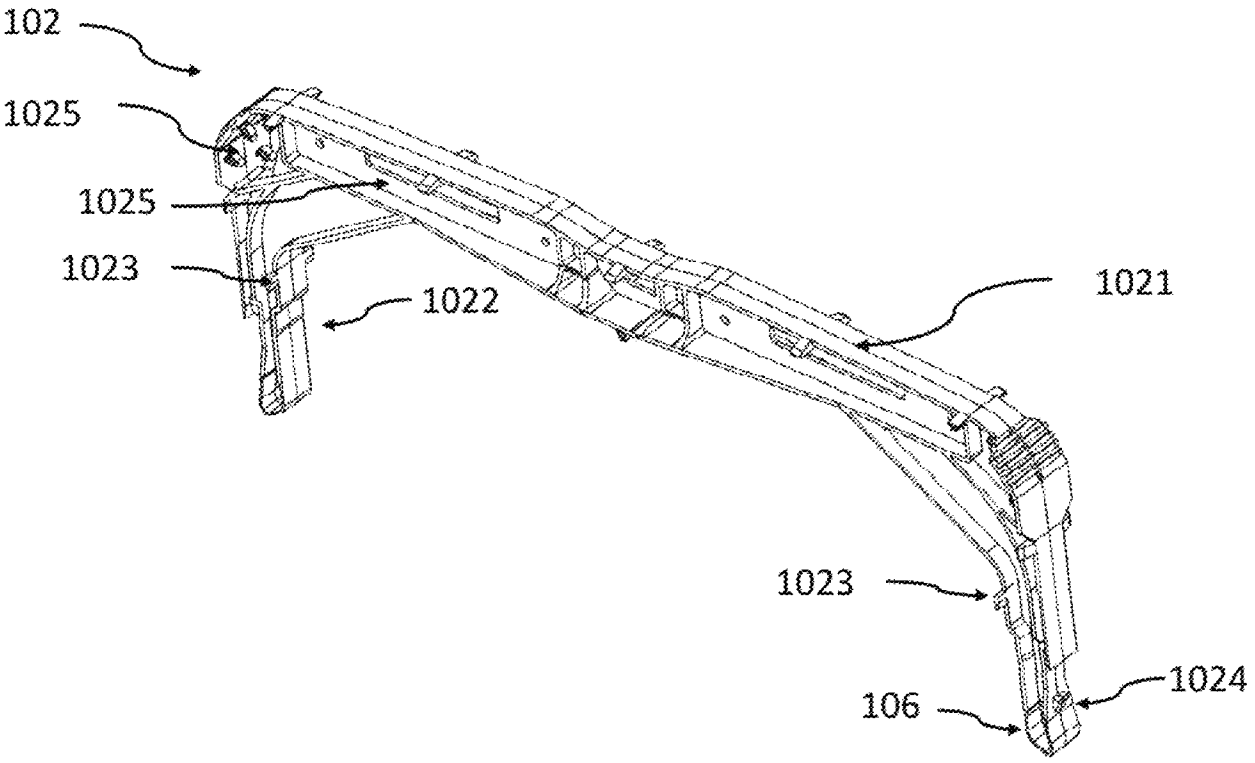
FIG. 4*a* is a schematic perspective view of a radome support according to an embodiment of the present disclosure.
Figure 4B:
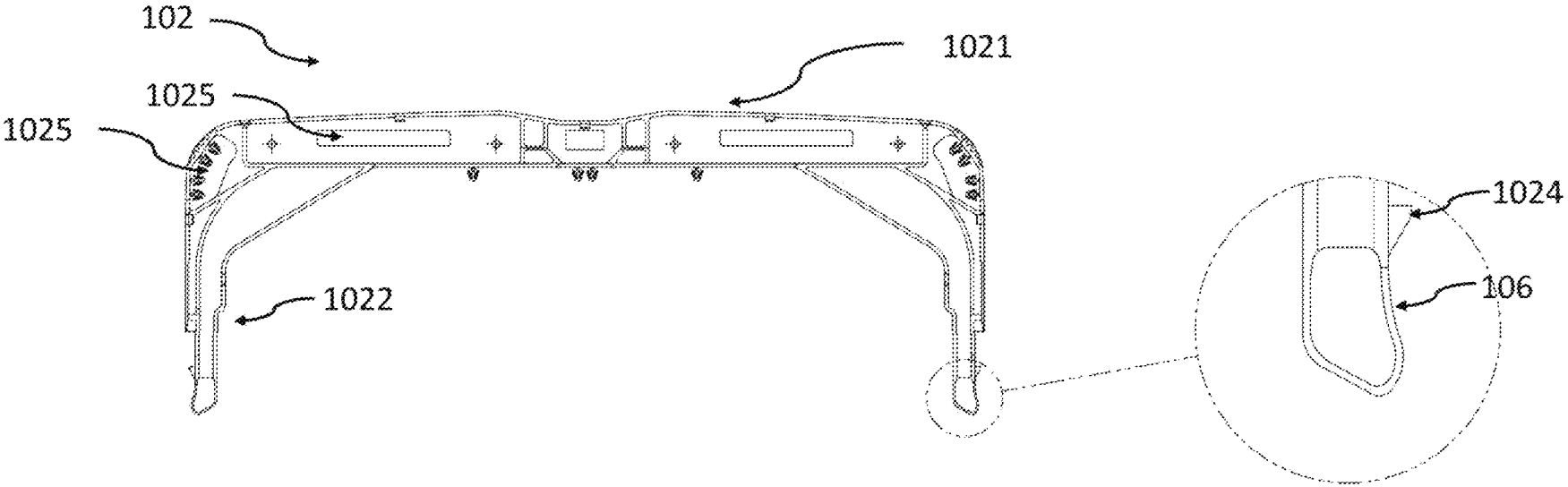
FIG. 4*b* is a schematic front view of the radome support of FIG. 4*a*.

Next, the radome support according to the present disclosure will be explained in detail with the aid of FIGS. 4*a* and 4*b*. Referring to FIG. 4*a*, a schematic perspective view of the radome support in accordance with an embodiment of the present disclosure is shown; with reference to FIG. 4*b*, a schematic front view of the radome support of FIG. 4*a* is shown.

In the present disclosure, the radome support 102 may be configured as an arc-shaped injection-molded part, which may span from the first side to the opposite second side of the reflector 101 (the body portion 1011) in the width direction H. It is to be noted that in performance testing such as vibration testing of the base station antenna, the stability of the radome support is assessed, wherein the stability of the radome support in the width direction has a significant influence on the mechanical and electrical performances of the base station antenna. Next, how the radome support according to the present disclosure is mounted on the reflector in a reliable and efficient manner, particularly for ensuring the stability of the radome support in the width direction, will be explained in detail.

As shown in FIGS. 1 and 4*a*, the radome support 102 may include a support portion 1021 for supporting the radome, and a mating portion 1022 for mating with the reflector 101. A first support limiting portion 1023 may be provided on the mating portion 1022 of the radome support 102.

Correspondingly, a first reflector limiting portion 1013 mating with the first support limiting portion 1023 is provided on the body portion 1011 of the reflector 101. The first support limiting portion 1023 and the first reflector limiting portion 1013 mate with each other to limit the position of the radome support 102 at least in the width direction H of the reflector 101.

In the present disclosure, mating of the mating portion 1022 of the radome support 102 with the body portion 1011 of the reflector 101 may be advantageous in that: Firstly, mounting of the radome support 102 may be accomplished by "shape fitting," without the need for a costly mounting process; secondly, unlike the bent portion 1012 of the reflector 101, the body portion 1011 of the reflector 101 is configured as a substantially flat plane, so that the manufacturing precision of the body portion 1011 of the reflector 101 may not have additional error due to bending, that is, the body portion 1011 of the reflector 101 may have higher manufacturing precision. In this way, the first reflector limiting portion 1013 may be constructed on the body portion 1011 of the reflector 101 at higher precision, thereby preventing the radome support 102 from being difficult to mount or the mounting stability from deteriorating due to manufacturing errors. According to the present disclosure, the first reflector limiting portion 1013 and the first support limiting portion 1023 are allowed to be tightly fitted together, thereby at least improving the stability of the radome support 102 in the width direction H.

In some embodiments, the first support limiting portion 1023 may be a component that is integrally formed on the mating portion 1022 of the radome support 102. In other embodiments, the first support limiting portion 1023 may also be a component that is additionally mounted on the mating portion 1022 of the radome support 102.

In the present embodiment, the first support limiting portion 1023 may be configured as a first protrusion 1023 on the mating portion 1022, which first protrusion may protrude from a body of the mating portion 1022 in the length direction V. Correspondingly, the first reflector limiting portion 1013 may be configured as a first groove in the body portion 1011 of the reflector 101, and said first groove 1013 may also extend in the length direction V. The first protrusion 1023 may be configured to be snapped into the first groove 1013, and the first groove 1013 can at least limit the position of the radome support in the width direction H. The engagement of the first protrusion 1023 with the first groove 1013 can be clearly seen in the partial enlarged view of FIG. 1. In the present disclosure, as the first groove 1013 can be constructed at a higher precision, the first protrusion 1023 and the first groove 1013 can be tightly fitted together, advantageously avoiding a groove that is too small or too large, and thereby preventing difficult mounting (in the case of a too small groove) or insufficient engagement (in the case of a too large groove).

In other embodiments, the first support limiting portion 1023 and the first reflector limiting portion 1013 may have any other suitable forms. For example, the first support limiting portion may also be configured as a snap-fit portion on the mating portion, and the snap-fit portion may extend from the mating portion toward the body portion of the reflector. Correspondingly, the first reflector limiting portion may be configured as a limiting hole in the body portion of the reflector. Thus, in the process of mounting the radome support onto the reflector, it only needs to directly snap the snap-fit portion on the radome support into the corresponding limiting hole in the reflector. Here, the snap-fit portion can limit the position of the radome support in the width direction H, the length direction V, and the forward-backward direction F.

It is advantageous for the mating portion of the radome support to be mated with the body portion of the reflector: unlike the bent portion of the reflector, the body portion of the reflector is configured as a substantially flat plane, so that the manufacturing precision of the body portion of the reflector may not have additional error due to bending, that is, the body portion of the reflector can have a higher manufacturing precision than the bent portion. Thus, the first reflector limiting portion can be constructed on the body portion of the reflector at higher precision, thereby preventing the radome support from being difficult to mount or the mounting stability from deteriorating due to the manufacturing errors. According to the present disclosure, the first reflector limiting portion and the first support limiting portion are allowed to be tightly fitted together, thereby improving at least the stability of the radome support in the width direction H.

In the present disclosure, a second support limiting portion 1024 may be further disposed on the mating portion 1022 of the radome support 102, and a second reflector limiting portion 1014 is provided on the bent portion 1012 of the reflector 101. The second reflector limiting portion and the second support limiting portion mate with each other to limit the position of the radome support 102 at least in the forward-backward direction F of the reflector 101.

In some embodiments, the second support limiting portion 1024 may be configured as a second protrusion on the mating portion 1022, and the second protrusion 1024 may protrude from the body of the mating portion 1022 in the width direction H. Correspondingly, the second reflector limiting portion 1014 may be configured as a second groove in the bent portion 1012, for example, in the first section 1012' of the reflector 101. The second protrusion 1024 may be configured to be snap-fitted into the second groove 1014. The engagement of the second protrusion 1024 with the second groove 1014 can be clearly seen in the partial enlarged view of FIG. 2*d*. In the present disclosure, the tight fitting of the second protrusion 1024 with the second groove 1014 may limit at least the position of the radome support in the forward-backward direction F.

In the present disclosure, an interference elastic portion 106 may be further disposed on the mating portion 1022 of the radome support 102, which interference elastic portion 106 may be integrally formed on the mating portion 1022 of the radome support 102. Referring to FIG. 4*a*, the interference elastic portion 106 may be formed on an end of the mating portion 1022 and constructed as a hollow portion. The mating portion 1022 of the radome support 102 may pass at least partially through a slot in the reflector 101, and the interference elastic portion 106 may accordingly abut against the bent portion 1012, for example, an inner surface of the first section 1012', of the reflector 101. According to the present disclosure, the interference fitting between the interference elastic portion and the bent portion of the reflector can further improve at least the stability of the radome support in the width direction H. Further, by means of the interference fitting between the interference elastic portion and the reflector, the radome support is advantageously prevented from being tilted or deflected from the reflector.

In the present disclosure, an opening 1025 may be provided in the radome support 102, for example, in its support portion 1021, by means of which opening a parasitic element or a RF tuning element may be mounted. Referring to FIG. 1, the parasitic elements (not shown for clarity) for corresponding radiating elements may be disposed around the radiating elements or between adjacent radiating elements through the corresponding openings 1025. The parasitic elements are typically used to improve the beamforming performance of the arrays of radiating elements. For example, part of the parasitic elements may be configured, for example, to tune the beam width of the arrays of radiating elements, while another part of the parasitic elements may be configured to improve the isolation performance between adjacent radiating elements.

Although exemplary embodiments of this disclosure have been described, those skilled in the art should appreciate that many variations and modifications are possible in the exemplary embodiments without materially departing from the spirit and scope of the present disclosure. Accordingly, all such variations and modifications are intended to be included within the scope of this disclosure as defined in the claims. The present disclosure is defined by the appended claims, and equivalents of these claims are also contained.

What is claimed is:

1. A base station antenna, characterized in that the base station antenna comprises:

a reflector and a radome support mounted on the reflector, wherein the reflector comprises a body portion and a bent portion, the bent portion including at least a first section that is connected to and bent relative to the body portion of the reflector, wherein one or more arrays of radiating elements are mounted on or above the body portion of the reflector, wherein the radome support includes a support portion for supporting the radome and a mating portion for mating with the reflector, wherein a first support limiting portion is provided on the mating portion of the radome support, a first reflector limiting portion is provided on the body portion of the reflector, and the first support limiting portion mates with the first reflector limiting portion to limit at least a position of the radome support in a width direction H, and wherein a second support limiting portion is provided on the mating portion of the radome support, and correspondingly a second reflector limiting portion is provided on the bent portion of the reflector.

2. The base station antenna according to claim 1, characterized in that the first support limiting portion is configured as a first protrusion on the mating portion, the first reflector limiting portion is configured as a first groove in the body portion of the reflector, and the first protrusion is configured to be snapped into the first groove, the first groove limiting at least the position of the radome support in the width direction H.

3. The base station antenna according to claim 2, characterized in that the first reflector limiting portion and the first support limiting portion mate with each other to limit at least the position of the radome support in the width direction H and a length direction V.

4. The base station antenna according to claim 2, characterized in that the first protrusion is configured as an extension bar extending in a length direction V on the mating portion.

5. The base station antenna according to claim 1, characterized in that the second reflector limiting portion mating with the second support limiting portion limits at least the position of the radome support in a forward-backward direction F.

6. The base station antenna according to claim 5, characterized in that the second reflector limiting portion is provided on the first section of the bent portion.

7. The base station antenna according to claim 5, characterized in that the second support limiting portion is configured as a second protrusion on the mating portion, the second reflector limiting portion is configured as a second groove in the bent portion, and the second protrusion is configured to be snapped into the second groove, the second groove capable of limiting at least the position of the radome support in the forward-backward direction F.

8. The base station antenna according to claim 1, characterized in that an interference elastic portion is further provided on the mating portion of the radome support.

9. The base station antenna according to claim 8, characterized in that the interference elastic portion abuts against the bent portion of the reflector.

10. The base station antenna according to claim 9, characterized in that the interference elastic portion abuts against an inner surface of the first section of the bent portion of the reflector.

11. The base station antenna according to claim 8, characterized in that the interference elastic portion is integrally formed on the mating portion of the radome support.

12. The base station antenna according to claim 8, characterized in that the interference elastic portion is configured as a hollow portion on the mating portion of the radome support.

13. The base station antenna according to claim 8, characterized in that the interference elastic portion is provided with a friction reinforcing structure on a surface thereof.

14. The base station antenna according to claim 1, characterized in that the radome support is constructed as an injection-molded part.

15. The base station antenna according to claim 1, characterized in that the base station antenna includes a plurality of radome supports, which are spaced apart from one another in a length direction V.

16. The base station antenna according to claim 1, characterized in that the radome support spans from a first side to an opposite second side of the reflector in the width direction H.

17. The base station antenna according to claim 1, characterized in that the bent portion further includes a second section connected to the first section and a third section connected to the second section, the second section being bent relative to the first section, and the third section being bent relative to the second section.

18. The base station antenna according to claim 17, characterized in that the second section is bent relative to the first section at an angle ranging from 85 to 95 degrees, and the third section is bent relative to the second section at an angle ranging from 85 to 95 degrees.

19. The base station antenna according to claim 17, characterized in that the second section is bent leftward or rightward with respect to the first section, and the third section is bent upward or downward with respect to the second section.

20. The base station antenna according to claim 17, characterized in that a phase shifting network and/or a feed network is mounted on the third section of the bent portion.

21. The base station antenna according to claim 1, characterized in that the first section is bent relative to the body portion of the reflector at an angle ranging from 85 to 95 degrees.

22. The base station antenna according to claim 1, characterized in that the first section is bent downward or upward relative to the body portion of the reflector.

23. The base station antenna according to claim 1, characterized in that the radome support is configured as an arc-shaped support.

24. A base station antenna, characterized in that the base station antenna comprises:

a reflector and a radome support mounted on the reflector, wherein the reflector comprises a body portion and a bent portion, the bent portion including at least a first section that is connected to and bent relative to the body portion of the reflector, wherein one or more arrays of radiating elements are mounted on or above the body portion of the reflector, and wherein a phase shifting network and/or a feed network is mounted on the bent portion, wherein the radome support includes a support portion for supporting the radome and a mating portion for mating with the reflector, wherein a first support limiting portion is provided on the mating portion of the radome support, a first reflector limiting portion is provided on the body portion of the reflector, and the first support limiting portion mates with the first reflector limiting portion to limit at least a position of the radome support in a width direction H.

25. A base station antenna, characterized in that the base station antenna comprises:

a reflector and a radome support mounted on the reflector, wherein the reflector comprises a body portion and a bent portion, the bent portion including at least a first section that is connected to and bent relative to the body portion of the reflector, wherein one or more arrays of radiating elements are mounted on or above the body portion of the reflector, wherein the radome support includes a support portion for supporting the radome and a mating portion for mating with the reflector, wherein a first support limiting portion is provided on the mating portion of the radome support, a first reflector limiting portion is provided on the body portion of the reflector, and the first support limiting portion mates with the first reflector limiting portion to limit at least a position of the radome support in a width direction H, and wherein the support portion of the radome support is provided therein with an opening, by means of which a parasitic element for the radiating element is mounted.

* * * * *